US005799328A

United States Patent [19]

Harlem et al.

[11] Patent Number: 5,799,328

[45] Date of Patent: Sep. 1, 1998

[54] REHABILITATIVE GARMENT FOR PERSONS AFFLICTED WITH BRAIN DAMAGE

[76] Inventors: Steven H. Harlem; Davida P. Harlem, both of 3564 Chimney Swift Dr., Huntington Valley, Pa. 19006

[21] Appl. No.: 850,441

[22] Filed: May 5, 1997

Related U.S. Application Data

[63] Continuation of Ser. No. 562,097, Nov. 22, 1995, abandoned.

[51] Int. Cl.[6] ..... A41B 1/08; A41D 1/06

[52] U.S. Cl. ..... 2/69; 2/83; 2/114; 2/125; 2/227; 2/271

[58] Field of Search ..... 2/69, 94, 115, 2/114, 125, 111, 51, 300, 311, 312, 313, 314, 317, 318, 320, 16, 59, 269, 271, 227, 22, 79, 101, 83, 80, 229, 230, 231, 241; 128/873, 874, 875, 870, 878, 882; 601/23, 33, 34

[56] References Cited

U.S. PATENT DOCUMENTS

| | | | |
|---|---|---|---|
| 273,770 | 3/1883 | Shelby | 2/313 |
| 1,336,339 | 4/1920 | Beale | 2/59 |
| 1,666,017 | 4/1928 | Lininger | 2/313 |
| 1,805,766 | 5/1931 | Groves | 2/111 |
| 2,715,226 | 8/1955 | Weiner | 2/93 |
| 3,562,812 | 2/1971 | Greggains | 2/94 |
| 4,253,197 | 3/1981 | Posta | 2/69 |
| 4,258,440 | 3/1981 | McGowen | 2/114 |
| 4,330,120 | 5/1982 | Netti | 2/160 |
| 4,389,734 | 6/1983 | Franz et al. | 2/59 |
| 4,599,750 | 7/1986 | Rahaman | 2/271 |
| 4,637,078 | 1/1987 | Southwell | 2/408 |
| 4,731,882 | 3/1988 | Ekman | 2/94 |
| 4,754,500 | 7/1988 | Brucato et al. | 2/105 |
| 4,856,112 | 8/1989 | Effle | 2/59 |
| 5,001,782 | 3/1991 | Stewart | 2/69 |
| 5,010,589 | 4/1991 | Hamilton | 2/94 |
| 5,033,117 | 7/1991 | Fairweather | 2/94 |
| 5,063,919 | 11/1991 | Silverberg | 2/59 |
| 5,131,684 | 7/1992 | Dandy, III et al. | 2/312 |
| 5,144,694 | 9/1992 | Conrad Daoud et al. | 2/69 |
| 5,289,590 | 3/1994 | Larson | 2/227 |
| 5,361,418 | 11/1994 | Luzenske | 2/94 |
| 5,398,305 | 3/1995 | Romney | 2/69 |
| 5,410,758 | 5/1995 | Dupont et al. | 2/51 |
| 5,418,978 | 5/1995 | Hochman | 2/69 |

*Primary Examiner*—Amy B. Vanatta
*Attorney, Agent, or Firm*—LaMorte & Associates

[57] ABSTRACT

A garment designed to help in the physiological and psychological rehabilitation of a hemiplegic patient. Disposed on the shirt sleeves and the pants legs of the garment are graspable elements, such as hoops or handles. Within each of the shirt sleeves and pants legs are reinforced areas that are joined to the graspable elements. The reinforced areas branch out across the material of the shirt sleeve or the pants leg. As a result, when a pulling force is applied to the graspable element, the force is transferred throughout the sleeve or leg by the reinforced areas. This enables a sleeve to be pulled onto an arm or a pants leg to be pulled onto a leg by applying a pulling force to just one position, thereby providing the ability for a person to use a partially disabled arm when dressing. In a preferred embodiment, small weights are positioned within the garment at various points along the sleeves and pants legs. The weights provide an increased tactile sensation to the arms and legs as the arms and legs are moved. The enhanced tactile sensation promotes improved proprioception, thereby helping a hemiplegic patient recognize and control the position of their limbs when moving his/her limbs. Color coding is provided on the garment to facilitate exteroception.

13 Claims, 3 Drawing Sheets

REHABILITATIVE GARMENT FOR PERSONS AFFLICTED WITH BRAIN DAMAGE

This is a continuation of application Ser. No. 07/562,097, filed Nov. 22, 1995, entitled REHABILITATIVE GARMENT FOR PERSONS AFFLICTED WITH BRAIN DAMAGE now abandoned.

BACKGROUND OF THE INVENTION

1. Field of the Invention

The present invention relates to garments specifically designed for the disabled. More particularly, the present invention relates to garments for the upper and lower torso that promote the physical, cognitive and emotional rehabilitation of people with central nervous system impairments such as those caused by a cerebral vascular accident.

2. Description of the Prior Art

Each year thousands of people incur brain damage due to trauma, stroke, transient ischemic attack, tumor growth and like afflictions. Often such brain damage results in hemiplegia or hemiparesis where the patient becomes either paralyzed or partially paralyzed on their right or left sides. Such damage to the central nervous system can have many symptoms other than partial or total physical paralysis. In many instances, a patient can experiences hemianopsia wherein the patient loses half a field of vision in both eyes. This commonly causes the patient to ignore or neglect items in the non-visible field. Since either the left or right field of vision is neglected, left/right directional confusion commonly occurs. Central nervous system damage, resulting in hemiparesis or hemiplegia also may be characterized by abnormal left/right proprioception, wherein tactile stimuli from the effected half of the body are not perceived by the brain in the normal manner. As a result, the patient may have difficulty in controlling muscle response in non-paralyzed portions of the effected body half. This leads to difficulties in maintaining balance and makes it difficult for a patient to perceive the position of his/her limbs.

As can be understood, a patient having difficulties perceiving and moving half of his/her body faces tremendous difficulties in dressing himself/herself. Dressing oneself is one of those fundamental activities that is greatly disheartening and frustrating to a person newly afflicted with central nervous system damage. However, dressing oneself is also one of those fundamental activities that must be mastered before the patient can again become self-sufficient. As such, the ability of a patient to dress himself/herself is a milestone that raises the emotional well being of the patient by showing him/her that he/she is well on his/her way to recovery and self-sufficiency.

The prior art has many garments that are intended for the physically handicapped and the infirm, however such garments are not well suited to the specific needs of a patient experiencing hemiplegia or hemiparesis. For instance, U.S. Pat. No. 4,258,440 to McGowan, entitled CLOTHES FOR THE PHYSICALLY HANDICAPPED discloses clothes with VELCRO® fastened seams that enable the clothes to be opened into flat orientations and wrapped around a disabled person. Such clothing may be beneficial to a nurse dressing a quadriplegic, however, such clothing would be more difficult to put on with one hand by a hemiplegic patient than would ordinary clothing.

U.S. Pat. No. 4,754,500 to Brucato et al., entitled SPECIAL GARMENT FOR THE DISABLED AND INFIRM discloses clothes with matching false fronts that act as bibs.

Again, such clothing is helpful in providing care to a quadriplegic but such clothing would be of no advantage to a hemiplegic patient.

It is therefore an objective of the present invention to provide garments specifically designed for the needs of a patient with hemiplegia or hemiparesis, wherein the garment is designed to be placed on the body with one hand.

It is a further objective of the present invention to provide a garment for patients suffering with hemiplegia or hemiparesis that promotes proprioception as well as exteroception and helps to counteract the left/right confusion commonly associated with ailments.

It is yet another objective of the present invention to provide garments for a patient with hemiplegia or hemiparesis that are aesthetically pleasing and not noticeably different in appearance from ordinary clothing.

SUMMARY OF THE INVENTION

The present invention is a garment designed to help in the physiological and psychological rehabilitation of a patient that had incurred an injury to his/her central nervous system. The garments of the present invention that are designed for the upper body, such as shirts, jackets and the like, contain sleeves. The garments of the present invention designed for the lower body, such as pants, contain legs. Disposed on the sleeves and the pants legs are graspable elements such as hoops or handles. Within each of the sleeves and legs are reinforced areas that are joined to the graspable elements. The reinforced areas branch out across the material of the sleeve or the pants leg. As a result, when a pulling force is applied to the graspable element, the force is transferred throughout the sleeve or leg by the reinforced areas. This enables a sleeve to be pulled onto an arm, or a pants leg to be pulled onto a leg, by applying a pulling force to just one position, thereby providing the ability for a person to use a partially disabled arm when dressing.

The present invention garment also contains color coding to facilitate right/left identification and coordination. Additionally, the garments have hook and loop fasteners to promote ease of use with one hand. Furthermore, the garments are sized to accept limbs encumbered by rehabilitative braces. In a preferred embodiment, small weights are positioned within the garment at various points along the sleeves and pants legs. The weights contact the arms and legs of the patient and provide an increased tactile sensation to the arms and legs as the arms and legs are moved. The enhanced tactile sensation promotes improved proprioception, thereby helping a hemiplegic patient recognize and control the position of his/her limbs when moving those limbs.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the functional aspects of the present invention can be incorporated into almost any garment, such as a coat, a dress, a sweater or the like, the present invention is especially well suited for incorporation into casual wear garments such as shirts and pants. Accordingly, the present invention will be described embodied into a casual shirt and pants in order to set forth the best mode contemplated for the invention.

Figure 1:
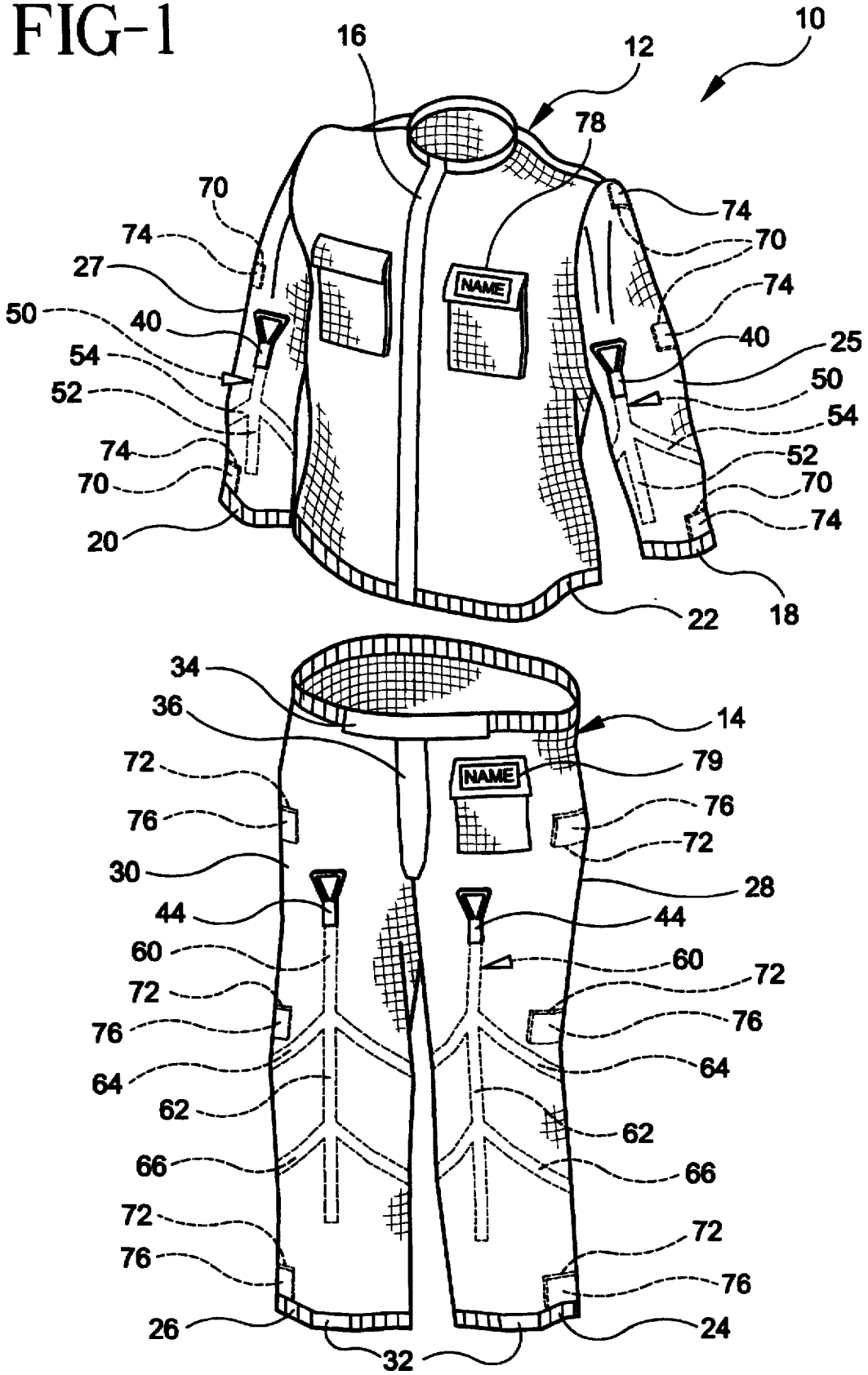
FIG. 1 is a front perspective view of one preferred embodiment of the present invention garment, embodied within both a shirt and a pair of pants.

Referring to FIG. 1, there is shown one preferred embodiment of the present invention garment 10. The exemplary embodiment shows the present invention garment 10 in the form of a long sleeved shirt 12 and a pair of pants 14. The purpose of the present invention is to provide a garment system to a person suffering from hemiplegia or hemiparesis, wherein the garment system helps in the physical, cognitive and emotional rehabilitation of the patient. In FIG. 1, the shirt 12 provided, does not contain buttons, as would a traditional shirt or blouse of the same style. Rather, the shown shirt 12 contains a vertical forward seam 16 that is held closed by hook and loop fasteners such as VELCRO®. By providing a vertical forward seam 16 with hook and loop fasteners, the vertical forward seam 16 of the shirt 12 can be more readily opened or closed with one hand. As such, the shirt 12 is particularly well suited for people with either abnormal left or right side motor controls or abnormal left-side/right-side proprioception.

It will be understood that the shown position of the seam 16 is merely exemplary for the style of shirt shown. The seam can also be positioned in the rear of the shirt or near the side of the shirt depending upon the style of the shirt being produced.

In the shown embodiment, the shirt 12 has elastic sleeve cuffs 18, 20 and an elastic waist 22, thereby providing the shirt 12 with the overall appearance of a jogging suit shirt or a similar athletic oriented shirt. However, it should be understood that the shirt could be formed as a dress shirt, jacket, sweater or any other garment for the upper torso. The use of elastic sleeve cuffs 18, 20 is preferred because the elastic structure of such cuffs would help hold the cuff in position on the arm. When putting on the shirt 12 with one hand, this would be highly advantageous because the elastic structure of the cuffs 18, 20 would prevent the cuffs 18, 20 from falling off the immobile arm when the shirt 12 is repeatedly grasped and released by the mobile arm during dressing. The elastic cuffs 18, 20 would therefore prevent a hemiplegic patient from experiencing the frustration of having the shirt 12 repeatedly fall out of a desired position while dressing with one hand.

The pants 14, in the shown embodiment, also preferably have elastic cuffs 24, 26 at the base of each leg 28, 30. However, a crossing flap 32 may optionally be provided on each cuff 24, 26, thereby enabling each cuff 24, 26 to be adjusted between an unrestricted open condition and a restricted closed condition. The crossing flaps 32 are provided with hook and loop fasteners that enable the easy one handed manipulation of the crossing flaps 32 between the unrestricted open condition and the restricted closed condition. The ability to open each cuff 24, 26 into an unrestricted open condition would enable each cuff to easily pass over a shoe, cast or brace as the pants 14 are being put on. Since many new patients with central nervous system damage use leg braces, the ability for the pants 14 to accommodate such braces is apparent.

The pants 14 also use a crossing flap 34 to adjust the waistline of the pants 14. The waistline crossing flap 34 enables the waistline of the pants 14 to be opened widely, thereby enabling easy access of a brace encumbered leg. The crossing flap 34 and the fly 36 below the crossing flap 34 both include hook and loop fasteners. The use of hook and loop fasteners on both the waistline crossing flap 34 and fly 36 permits the easy one-handed opening and closing of these structures. The hook and loop fasteners also eliminate the need for buttons, hooks and zippers which are very difficult to fasten with only one hand.

A key feature of the present invention garment 10 is the use of grasping tabs on the limb portions of both the shirt 12 and the pants 14. In the shown embodiment, two grasping tabs 40 are disposed on the shirt 12 and a plurality of grasping tabs 44 are disposed on the pants 14. The grasping tabs 40 are attached to a forward exterior surface of each shirt sleeve 25, 27 and to the front and back of each pants leg 28, 30. The grasping tabs 40, 44 preferably are flexible hoops made of fabric or rigid hoops made of plastic or metal. Regardless of the material of the grasping tabs 40, 44, it is desirable that the grasping tabs have a hoop configuration, T-shaped configuration or another configuration that enables the grasping tabs 40, 44 to be easily grasped and pulled with one hand.

On the shirt 12, a single grasping tab 40 is positioned on each shirt sleeve 25, 27 at a position between the shoulder and the elbow of the sleeve. The use of a single grasping tab 40 on each sleeve 25, 27 is merely exemplary and it should be understood that multiple grasping tabs could be used on each sleeve 25, 27 if desired.

The grasping tabs 40 are affixed to the exterior of the shirt sleeves 25, 27 in a forward facing orientation so that they can be easily reached by the opposite arm.

Reinforcement strips 50 are disposed on each sleeve 25, 27 of the shirt 12. The reinforcement strips 50 are made from a flexible material or fabric that does not significantly stretch when pulled in tension. The reinforcement strips 50 are attached to the material of the sleeves 25, 27 and may be either on the interior or exterior of the sleeves 25, 27. The reinforcement strips 50 are joined to the shirt sleeves 25, 27 proximate the grasping tabs 40. As such, when a grasping tab 40 is manually grasped and pulled, the pulling force is experienced by the reinforcement strips 50. Although the reinforcement strips 50 can have many orientations, the shown preferred embodiment includes a vertical strip 52 that extends down the front center of each sleeve 25, 27 from the grasping tab 40 to a point proximate the sleeve cuffs 18, 20. A lateral hoop 54 extends from the vertical strip 52 and circumvents each sleeve 25, 27 at a point between the grasping tabs 40 and the sleeve cuffs 18, 20. As a result, when a grasping tab 40 is pulled, the pulling force is distributed down the vertical strip 52 and around the lateral hoop 54, thereby causing the entire sleeve 25, 27 to move upwardly in unison without binding. Consequently, a patient with hemiplegia or hemiparesis would only have to grasp and pull a grasping tab 40 in order to advance a sleeve 25, 27 up and onto the afflicted arm. More importantly, the use of the easily gripped grasping tab 40 enables the afflicted arm to more easily engage the shirt sleeve 25, 27, wherein the afflicted arm may be guided to the grasping tab 40 by the non-afflicted arm. Thus, by moving the afflicted arm upwardly in any manner, the shirt sleeve 25, 27 can be pulled onto the opposite arm. This would thereby enable a patient with hemiplegia or hemiparesis to use his/her afflicted arm in dressing even if the afflicted arm has limited movement and little or no finger control.

Figure 2:
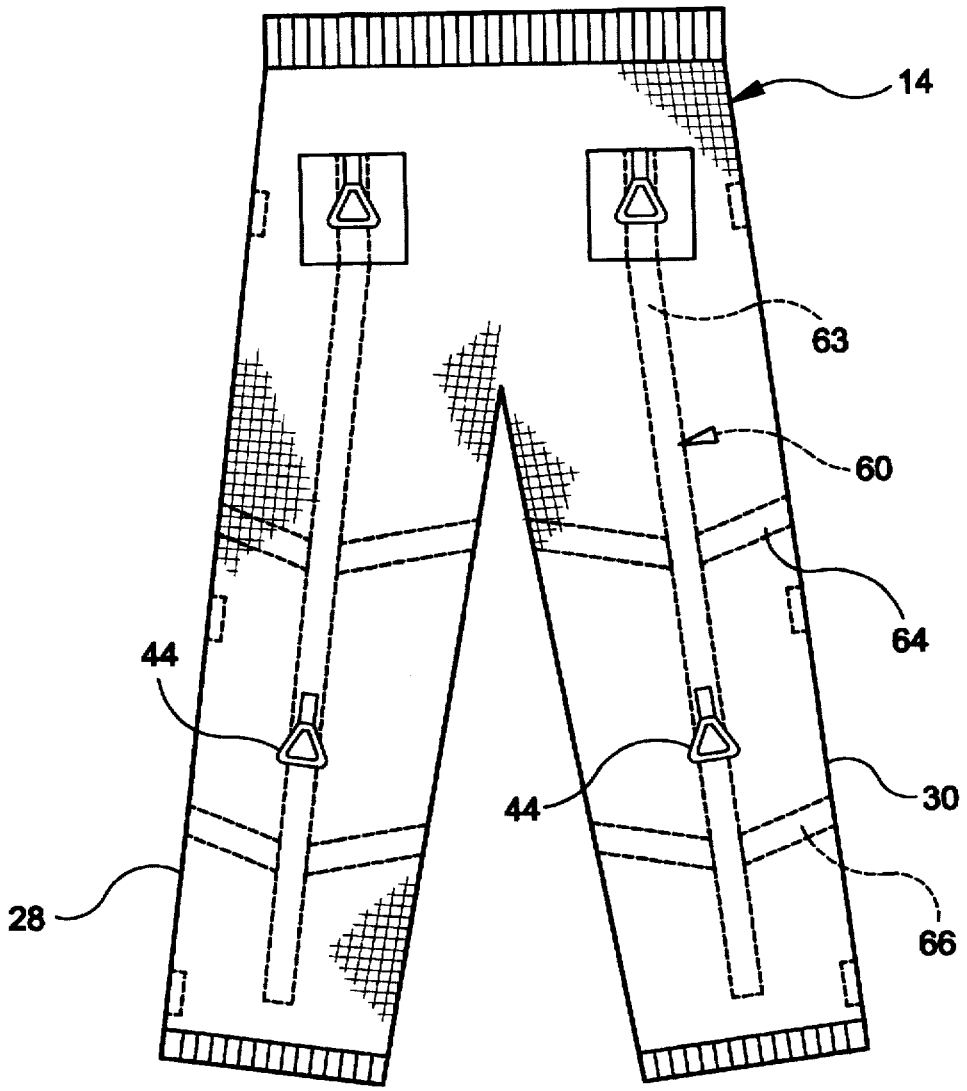
FIG.2 is a rear view of the present invention pants shown in FIG. 1.

Referring To FIG. 2 in conjunction with FIG. 1, it can be seen that reinforcement strips 60 are also disposed within each leg 28, 30 of the present invention pants 14. The reinforcement strips 60 are made of the same material as the shirt reinforcement strips 50 and can be attached to either the interior or exterior of the pants legs 28, 30. The reinforcement strips 60 create reinforced regions with the pants legs 28, 30 onto which the various grasping tabs 44 attach. As a result, when a grasping tab 44 is manually grasped and pulled, the pulling force is experienced by the reinforced areas of the pants legs 28, 30, via the reinforcement strips 60. Although the leg reinforcement strips 60 can have many configurations, the shown embodiment includes a front vertical strip 62 that extends down the front center of each pants leg 28, 30 from the thigh region to the calf region and a rear vertical strip 63 that extends down the front center of each pants leg 28, 30 from the thigh region to the calf region. In FIG. 1, it can be seen that two grasping tabs 44 on each leg attach to the material of the pants 14 at a point near the top of each front vertical strip 62. Two lateral hoops 64, 66 extend from the vertical strip 62 and circumvent each pants leg 28, 30. The first lateral hoop 64 extends around the pants leg 28, 30 proximate the calf region, while the second lateral hoop 64 is positioned at a higher point just above the knee. The use of two lateral hoops 64, 66 in the shown embodiment is merely exemplary and it will be understood that any plurality of lateral hoops can be used and those lateral hoops can extend from any point on the front vertical strip 62.

As a result of the presence of the vertical strip 62 and the various lateral hoops 64, 66 in each pants leg 28, 30, a pulling force applied to the grasping tabs 44 is distributed throughout the reinforced region of the pants leg 28, 30. A pulling force is therefore distributed down the front vertical strip 62 and around the lateral hoops 64, 66, whereby the entire pants leg below the grasping tabs 44 is moved upwardly without binding. Consequently, a patient would only have to grasp and pull a grasping tab 44 with one hand in order to advance a pants leg 28, 30 over a leg.

In FIG. 2, it can be seen that each of the lateral hoops 64, 66 also join to the rear vertical strip 63 that travels down the rear of each of the pants legs 28, 30. Two grasping tabs 44 on each leg attach to the material of the pants 14 at a point near the top of each the rear vertical strips 63. As a result of the presence of the rear vertical strip 62 and the various lateral hoops 64, 66 in each pants leg 28, 30, a pulling force applied to the grasping tabs 44 is distributed throughout the reinforced region of the pants leg 28, 30. A pulling force is therefore distributed down the rear vertical strip 63 and around the lateral hoops 64, 66, whereby the entire pants leg below the grasping tabs 44 is moved upwardly without binding. Consequently, a patient would only have to grasp and pull a grasping tab 44 on the rear of the pants in order to advance a the rear of the pants onto the body.

As has been previously stated, it is preferred that the grasping tabs 40, 44 on both the pants 14 and the shirt 12 be configured to be readily grasped with one hand. However, patients with hemiplegia or hemiparesis often have poor muscle control in the hand of an afflicted arm, and although the arm itself can be moved, the ability to grasp an object is lost. As a result, it is preferred that the grasping tabs 40, 44 of the present invention garment 10 have a hoop configuration through which at least a few fingers can pass. By using a hoop configuration on the grasping tabs 40, 44 a few fingers from the hand of the afflicted arm can be passed through the hoop configuration. Consequently, even if the afflicted hand does not have the ability to grasp an object, the afflicted hand can still be made to positively engage a grasping tab 40, 44. Therefore, if the afflicted arm has any ability to be moved upwardly, even if only at the shoulder, the afflicted arm and hand can be utilized in dressing. The controlled movement of the afflicted arm in dressing is rehabilitative and promotes physical rehabilitation. Furthermore, the freedom of the patient to dress and undress himself/herself is a milestone in recovery that adds greatly to the emotional and psychological aspects of rehabilitation.

An essential aspect of rehabilitation for a hemiplegic patient is the redevelopment of left/right discrimination. Since often the right or left side of the body is eliminated from the field of perception by brain damage, rehabilitation requires that the patient recognize the diminished field of perception and train himself/herself to recognize and control body movement within this diminished field of perception. The present invention garment 10 contains two features designed to aid in the rehabilitation of left/right recognition and proprioception. One feature is visual, while the second feature is tactile. The visual feature uses left/right color coding on both the shirt 12 and the pants 14, wherein the left sleeve 25 and the left pants leg 28 have similar color codes that are separate and distinct from the color codes of the right sleeve 27 and the right pants leg 30. In the shown embodiment, the color code is obtained by selectively coloring the sleeve cuffs 18, 20 and the pants leg cuffs 24, 26. The color coding can also be embodied by the various grasping tabs 40, 44 on the shirt sleeves 25, 27 and the pants legs 28, 30. For instance, the left shirt cuff 18, the left pants cuff 24 and the grasping tabs 40, 44 on the left shirt sleeve 25 and the left pants leg 28 can be colored green, while the right shirt cuff 20, the right pants cuff 26 and the grasping tabs 40, 44 on the right shirt sleeve 18 and the right pants leg 28 can be colored red. A person dressing himself/herself then would look for the color coding to assist in the discrimination of left and right. As a result, the color coding provides exteroceptive input to the patient to assist in distinguishing left from right.

The tactile feature of the present invention garment 10 includes the use of small weights coupled to the shirt sleeves 25, 27 and the pants legs 28, 30. Manufactured into the shirt sleeves 25, 27 and the pants legs 28, 30 are a plurality of pockets 70, 72. The pockets 70, 72 are sized to retain small metal weights 74, 76 of between one ounce and eight ounces. In the shirt 12, the pockets 70 are positioned proximate the shoulder, elbow and wrist in each sleeve 25, 27. In the pants 14, the pockets 72 are positioned proximate the hip, knee and ankle in each pants leg 28, 30. These weight areas are preferred because they correspond in position to the joints in the arms and legs. As a result, each time a joint in the arm or leg is moved, the weight 74, 76 contained in the weight pockets 70, 72 will be felt by the body. This adds an external tactile sensation to the movement of the arm or the leg. The tactile sensation provides proprioceptive input that helps the brain perceive the movement of either the arm or leg in time and space. The use of weights in the present invention garment can be selectively varied to meet the needs of an individual. For example, a person with severe hemiplegia may require large tactile sensations from the weights 74, 76. As such, the larger eight ounce weights would be used. As a person recovers, the need in degree of tactile sensation may decrease. Consequently, as rehabilitation progresses, the weights 74, 76 can be progressively decreased from the eight ounce size to the one ounce size. This also provides a gauge by which the patient can measure his/her progress during rehabilitation.

The present invention garment 10 is designed to highlight normalcy and not disability. As such, the present invention garment is designed to look as close as possible to normal clothing. However, for hospital and institutional use, it is desirable to have a patient's name displayed on the garment 10 to prevent that garment from being lost or misplaced during laundering. As a result, optional name tag panels 78, 79 can be added to the shirt 12 and pants 14, if desired.

Figure 3:
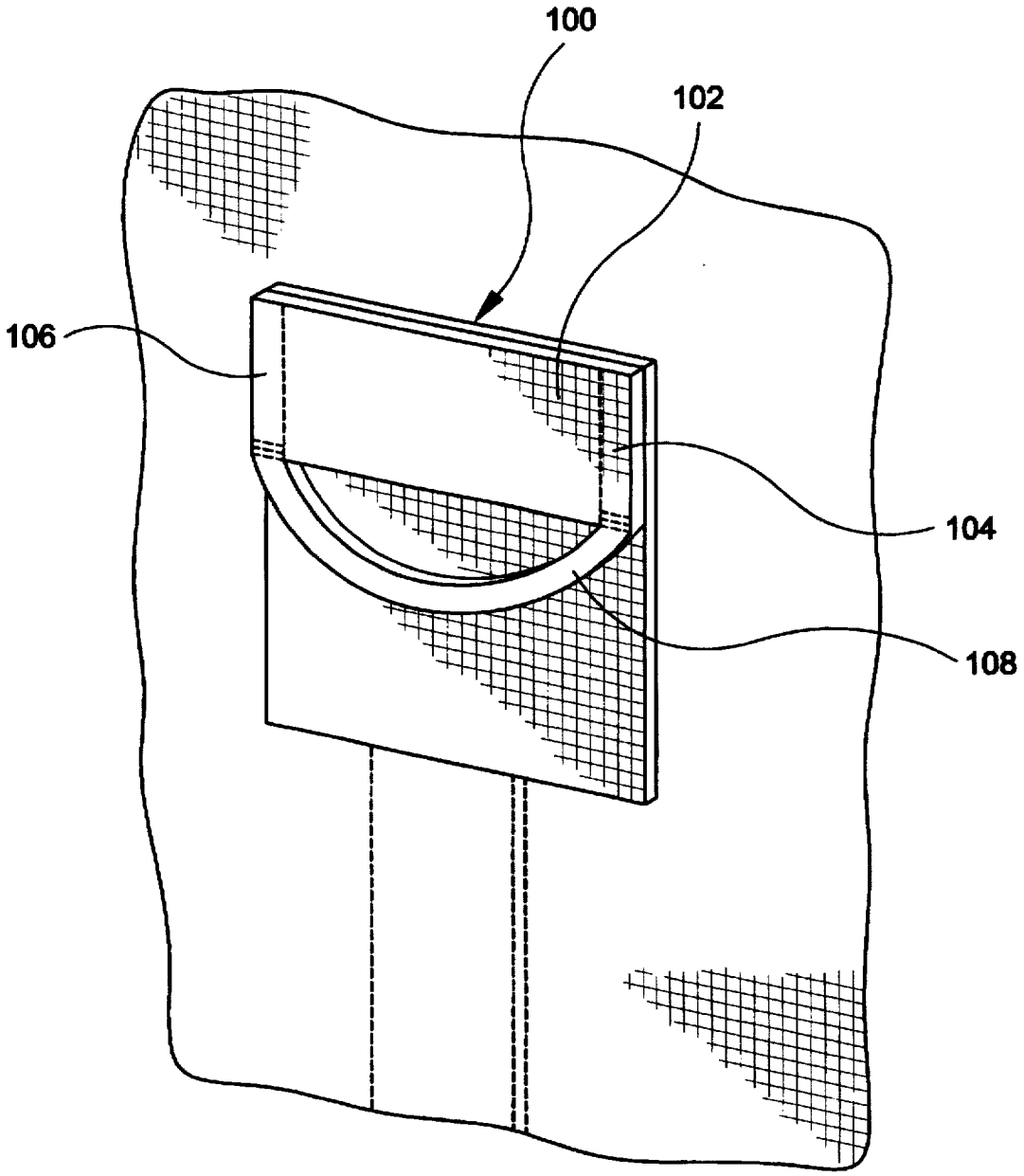
FIG. 3 is a perspective view of an alternate embodiment of a graspable element, wherein the graspable element is a hoop formed into the structure of false pocket in order to provide the present invention garment with a more normal appearance.

As has been explained, it is important to the emotional an psychological rehabilitation of a patient that the patient resumes normal activities and is perceived by others as being normal. The present invention garment 10 is mostly normal in appearance except for the grasping tabs 40, 44 that extend from the shirt 12 and pants 14. To further make the present invention garment 10 appear normal, the grasping tabs can be incorporated into the structure of a pocket, thereby producing a garment that merely appears to have pockets on the shirt sleeves and pants legs. Referring to FIG. 3 there is shown an embodiment of a pocket 100 that would incorporate a grasping tab within its construction. In the shown embodiment, the pocket 100 contains a pocket flap 102 that is sewn to the garment at its two side seams 104, 106. Extending from the pocket flap 102 is a hoop 108, that attaches to the two side seams 104, 106. This construction gives the hoop 108 the appearance of being stylish adornment on the pocket 100. The pocket 100 itself acts as a reinforcement element within the garment. As such, the various reinforcement strips within the shirt sleeve or pants leg can be attached to any part of the pocket 100. When dressing, a person can grasp the hoop 108 on the pocket 100 and pull up on the sleeve or pants leg in the previously described fashion.

It will be understood that the embodiments of the invention described above are merely exemplary and a person skilled in the art of garment manufacture could make many alternate embodiments using functionally equivalent components to those described. For example, the described embodiment used separate reinforcement strips that were added to a shirt and pants. In an alternate embodiment, those reinforcement strips can be made by creating seams in the shirt and pants where the material of the shirt and pants overlap. All such modifications are intended to be covered by the present invention as expressed by the appended claims.

What is claimed is:

1. A garment comprising:

a body section for covering a portion of the torso of a person's body:

a limb section that defines a generally cylindrical shaped opening adapted to be worn around the limb of a person, wherein said limb section has a first end coupled to said body section, a second end and a center region disposed in between said first end and said second end;

at least one fabric reinforcement structure having a predetermined length, wherein said at least one fabric reinforcement structure is sewn to said limb section along its predetermined length, said at least one fabric reinforcement structure including at least one fabric element that substantially circumvents said generally cylindrical shaped opening in said center region of said limb section, thereby producing a reinforced region within said limb section;

at least one graspable element coupled at a fixed position to an exterior surface of said limb section in said reinforced region, wherein said at least one graspable element has a hoop configuration through which at least one finger can be passed, whereby a pulling force applied to said at least one graspable element is directly transferred to said reinforced region, thereby distributing said pulling force to said limb section proximate said reinforced region.

2. The garment according to claim 1, wherein said limb section has a forward surface that faces forward on the person when worn, and said at least one graspable element is disposed on said forward surface.

3. The garment according to claim 1, wherein said limb section is a sleeve having a shoulder region proximate said first end, a cuff region proximate said second end and an elbow region disposed between said shoulder region and said cuff region.

4. The garment according to claim 3, wherein said graspable element is disposed proximate said elbow region of said sleeve.

5. The garment according to claim 1 , wherein said graspable element is disposed between said center region and said first end.

6. The garment according to claim 4, wherein said reinforcement structure further includes a fabric element that extends generally from said shoulder region toward said cuff region.

7. The garment according to claim 1, wherein said limb section is a pants leg having a thigh region proximate said first end, a cuff region proximate said second end and a knee region disposed between said thigh region and said cuff region.

8. The garment according to claim 7, wherein said graspable element is disposed on said thigh region.

9. The garment according to claim 7, wherein said reinforcement structure further includes a fabric element that extends generally from said thigh region toward said cuff region.

10. The garment according to claim 1, wherein said garment is a shirt having an openable seam, and hook and loop fasteners are disposed on said seam to enable said seam to be selectively opened and closed.

11. The garment according to claim 1, further including colored regions on each said limb section that identify a left/right orientation associated with said limb section.

12. The garment according to claim 1, further including at least one weight coupled to said limb section, wherein said weight provides a tactile sensation to a limb of a person wearing said garment.

13. The garment according to claim 7, wherein said cuff region includes a means for selectively increasing in size, thereby enabling an oversized object to pass through said cuff region.

* * * * *